US010913636B2

(12) United States Patent
Cao et al.

(10) Patent No.: US 10,913,636 B2
(45) Date of Patent: Feb. 9, 2021

(54) DEVICE AND METHOD FOR ADJUSTING TENSION OF A STEEL WIRE ROPE OF AN ULTRA-DEEP VERTICAL SHAFT AT A HOISTING-CONTAINER-END

(71) Applicants: CHINA UNIVERSITY OF MINING AND TECHNOLOGY, Jiangsu (CN); XUZHOU COAL MINE SAFETY EQUIPMENT MANUFACTURE CO., LTD., Jiangsu (CN)

(72) Inventors: Guohua Cao, Jiangsu (CN); Lifei Jiang, Jiangsu (CN); Zhencai Zhu, Jiangsu (CN); Weihong Peng, Jiangsu (CN); Chunli Hua, Jiangsu (CN); Gongbo Zhou, Jiangsu (CN); Yuxing Peng, Jiangsu (CN); Wei Li, Jiangsu (CN); Shizhe Feng, Jiangsu (CN); Shanzeng Liu, Jiangsu (CN)

(73) Assignees: CHINA UNIVERSITY OF MINING AND TECHNOLOGY, Jiangsu (CN); XUZHOU COAL MINE SAFETY EQUIPMENT MANUFACTURE CO., LTD., Jiangsu (CN)

( * ) Notice: Subject to any disclaimer, the term of this patent is extended or adjusted under 35 U.S.C. 154(b) by 0 days.

(21) Appl. No.: 16/077,981

(22) PCT Filed: Dec. 1, 2017

(86) PCT No.: PCT/CN2017/114244
§ 371 (c)(1),
(2) Date: Aug. 14, 2018

(87) PCT Pub. No.: WO2018/201712
PCT Pub. Date: Nov. 8, 2018

(65) Prior Publication Data

US 2020/0399095 A1 Dec. 24, 2020

(30) Foreign Application Priority Data

May 2, 2017 (CN) ..... 2017 1 0303461

(51) Int. Cl.
*B66B 7/10* (2006.01)

(52) U.S. Cl.
CPC ..... *B66B 7/10* (2013.01)

(58) Field of Classification Search
CPC ..... B66B 7/10; B66B 7/1215; B66B 11/0065; B66B 15/02; B66B 15/04
See application file for complete search history.

(56) References Cited

U.S. PATENT DOCUMENTS 1,725,402 A * 8/1929 Lindquist ..... B66B 7/10 187/412
1,854,182 A * 4/1932 Erwin ..... B66B 7/10 187/412

(Continued)

FOREIGN PATENT DOCUMENTS

CN 201873412 U 6/2011
CN 104444707 A 3/2015

(Continued)

*Primary Examiner* — Diem M Tran
(74) *Attorney, Agent, or Firm* — Foley & Lardner LLP

(57) ABSTRACT

The present invention discloses a device and method for adjusting tension of a steel wire rope of an ultra-deep vertical shaft at a hoisting-container-end. The device includes two stages of steel wire rope tension adjusting devices provided on a hoisting container, where a primary steel wire rope tension adjusting device includes left and right steel wire rope tension adjusting devices that are symmetrically arranged, and a secondary steel wire rope tension adjusting device is provided below the primary steel wire rope tension adjusting device. By use of two stages of steel wire rope tension adjusting devices, tension on four steel wire ropes can be adjusted to equalize the tension, thus (Continued)

meeting the requirement for tension equalization in a hoisting process. The four steel wire ropes are equally divided into two groups. Tension of two steel wire ropes is adjusted by rotating a primary drum around which the two steel wire ropes are wound, and then tension of the four steel wire ropes is adjusted by rotating a secondary drum around which the multiple steel wire ropes are wound, thus achieving a final purpose. The device of the present invention has a simple structure, and is conveniently mounted and easily detached. The tension is automatically adjusted by rotating the drums. This solution is novel and has wide application.

12 Claims, 3 Drawing Sheets

(56) References Cited

U.S. PATENT DOCUMENTS

| | | | | | |
|---|---|---|---|---|---|
| 1,915,486 | A | * | 6/1933 | Frost | B66B 7/10 187/412 |
| 1,940,249 | A | * | 12/1933 | Evans | B66B 7/10 187/412 |
| 1,964,982 | A | * | 7/1934 | Frost | B66B 7/10 187/412 |
| 2,704,651 | A | * | 3/1955 | Cummings | B66B 7/10 254/398 |
| 2004/0154876 | A1 | * | 8/2004 | Choi | B66B 7/10 187/412 |

FOREIGN PATENT DOCUMENTS

| | | | | |
|---|---|---|---|---|
| CN | 205472122 | | * | 8/2016 |
| CN | 106315349 | A | | 1/2017 |
| CN | 106946120 | A | | 7/2017 |
| DE | 721458 | C | * | 6/1942 |
| JP | 2001139253 | A | | 5/2001 |
| JP | 2009062132 | A | | 3/2009 |

* cited by examiner

DEVICE AND METHOD FOR ADJUSTING TENSION OF A STEEL WIRE ROPE OF AN ULTRA-DEEP VERTICAL SHAFT AT A HOISTING-CONTAINER-END

BACKGROUND OF THE INVENTION

Technical Field

The present invention relates to a device and method for adjusting tension of a steel wire rope of an ultra-deep vertical shaft at a hoisting-container-end, and particularly applies to tension adjustment for steel wire ropes in a multi-rope hoisting system of an ultra-deep vertical shaft.

Background

In a multi-rope hoisting system, in order to avoid unbalanced tension on hoisting steel wire ropes of the hoisting system because of inconsistent tension of multiple steel wire ropes connected to a hoisting container, it is required to add a tension adjusting device for the hoisting steel wire ropes, so as to ensure tension equalization of the hoisting system and meet safety requirement of the hoisting system. An existing tension adjusting manner involves generally adding a hydraulic tensioning device for the steel wire rope, which adjusts the tension of the steel wire rope through a hydraulic pressure. However, a hydraulic fluid easily leaks. In addition, due to limitation in the length of a plunger lever, the conventional hydraulic tensioning device for the steel wire rope can only adjust a steel wire rope by a short distance, failing to meet the requirement of the multi-rope hoisting system of an ultra-deep vertical shaft.

SUMMARY OF THE INVENTION

Technical problem: An objective of the present invention is to overcome the deficiencies in the prior art, and provide a tension adjusting device and method for a hoisting steel wire rope of an ultra-deep vertical shaft, where the adjusting device has a simple structure; and is secure and reliable, conveniently mounted and adjusted, and easily detached.

Technical solutions: A tension adjusting device for a hoisting steel wire rope of an ultra-deep vertical shaft provided by the present invention includes two stages of steel wire rope tension adjusting devices provided on a hoisting container, a primary steel wire rope tension adjusting device includes left and right steel wire rope tension adjusting devices that are symmetrically arranged, and the left and right steel wire rope tension adjusting devices each include guide rails, sliders, a spindle, connection blocks, and a drum, where the guide rails, the sliders, and the connection blocks are successively symmetrically arranged on two sides of the spindle, the drum is provided on the middle portion of the spindle, two hoisting steel wire ropes are symmetrically wound around the drum, and rope head ends of the two hoisting steel wire ropes are fixed to the drum with rope head lock blocks; and a secondary steel wire rope tension adjusting device is provided below the primary steel wire rope tension adjusting device, and includes a plurality of fixed bearing pedestals, revolving shafts, and drums, where each revolving shaft is provided with one drum, two ends of each revolving shaft are disposed inside the fixed bearing pedestals respectively, steel wire ropes are wound around each drum, and ends of the steel wire ropes are respectively connected to the connection blocks of the primary steel wire rope tension adjusting device via steel wire rope connection devices.

The left and right steel wire rope tension adjusting devices specifically include a primary left steel wire rope tension adjusting device and a primary right steel wire rope tension adjusting device; the primary left steel wire rope tension adjusting device includes two primary left guide rails, two primary left sliders, a primary left spindle, primary left connection blocks, a first hoisting steel wire rope and a second hoisting steel wire rope, a primary left drum, rope head lock blocks, and primary left steel wire rope connection devices; the primary left guide rails are fastened to the hoisting container, and the primary left sliders fit snugly to inner walls of the primary left guide rails; two ends of the primary left spindle are fixedly connected to the primary left sliders respectively, and move up and down along the primary left guide rails together; the primary left drum is mounted on a middle portion of the primary left spindle via a bearing, and is provided with spiral grooves for the steel wire ropes and lock blocks for fastening rope heads of the first hoisting steel wire rope and the second hoisting steel wire rope; the first hoisting steel wire rope is wound around the primary left drum and extends upwards from the front side of the primary left drum, and the second hoisting steel wire rope is wound around the primary left drum and extends upwards from the back side of the primary left drum; the primary left connection blocks are fastened on two sides of the primary left drum; and each of the primary left steel wire rope connection devices is connected upwards to one of the primary left connection blocks via a steel wire rope, and a lower end thereof is fastened to a secondary left drum by winding a steel wire rope from the front side of the drum.

The primary right steel wire rope tension adjusting device includes two primary right guide rails, two primary right sliders, a primary right spindle, primary right connection blocks, a third hoisting steel wire rope and a fourth hoisting steel wire rope, a primary right drum, and primary right steel wire rope connection devices; the primary right guide rails are fastened to the hoisting container, and the primary right sliders fit snugly to inner walls of the primary right guide rails; two ends of the primary right spindle are fixedly connected to the two primary right sliders respectively, and move up and down along the primary right guide rails together; the primary right drum is mounted on a middle portion of the primary right spindle via a bearing, and is provided with spiral grooves for the steel wire ropes and lock blocks for fastening rope heads of the third hoisting steel wire rope and the fourth hoisting steel wire rope; the third hoisting steel wire rope is wound around the primary right drum by four or more turns and extends upwards from the front side of the primary right drum, and the fourth hoisting steel wire rope is wound around the primary right drum by four or more turns and extends upwards from the back side of the primary right drum; the primary right connection blocks are fastened on two sides of the primary right drum; and each of the primary right steel wire rope connection devices is connected upwards to one of the primary right connection blocks via a steel wire rope, and a lower end thereof is fastened to a secondary right drum by winding a steel wire rope from the back side of the drum.

One, two or three primary left connection blocks are provided, each primary left connection block is provided with a primary left steel wire rope connection device; and one, two or three primary right connection blocks are provided, each primary right connection block is provided with a primary right steel wire rope connection device.

The primary left guide rails and the primary right guide rails are all rectangular guide rails, and the primary left sliders and the primary right sliders are all square blocks.

The first hoisting steel wire rope and the second hoisting steel wire rope are wound around the primary left drum by at least four turns, and the third hoisting steel wire rope and the fourth hoisting steel wire rope are wound around the primary right drum by at least four turns.

The secondary steel wire rope tension adjusting device includes a plurality of fixed bearing pedestals, revolving shafts, and drums; and specifically includes five bearing pedestals, four secondary revolving shafts, two secondary left drums, and two secondary right drums, where the bearing pedestals are fastened to the hoisting container, and the secondary revolving shafts are mounted on the five bearing pedestals; the secondary left drums are mounted on the secondary revolving shafts by means of a key connection and rotate in synchronization with the secondary revolving shafts, and the secondary left drums are each provided with spiral grooves for the steel wire ropes and lock blocks for fastening rope heads of the steel wire ropes; the secondary right drums are mounted on the secondary revolving shafts by means of a key connection and rotate in synchronization with the secondary revolving shafts, and the secondary right drums are each provided with spiral grooves for the steel wire ropes and lock blocks for fastening rope heads of the steel wire ropes; and the secondary left drum and the secondary right drum are identical in diameter.

A tension adjusting method for a hoisting steel wire rope of an ultra-deep vertical shaft is further provided, where the method uses the foregoing device, and includes the following cases:

(1) let a tensile force on a first hoisting steel wire rope be $F_1$ and a tensile force on a second hoisting steel wire rope be $F_2$, where when $F_1=F_2$, a primary left drum is subject to balanced forces at two sides and does not rotate; when $F_1>F_2$, a force acting on a front side of the primary left drum is greater than that on its back side, and the primary left drum rotates counterclockwise, such that the first hoisting steel wire rope is relatively loosened and $F_1$ decreases, the second hoisting steel wire rope is relatively tightened and $F_2$ increases, so as to make $F_1$ be equal to $F_2$ finally; when $F_1<F_2$, a force acting on a front side of the primary left drum is less than that on its back side, and the primary left drum rotates clockwise, such that the first hoisting steel wire rope is relatively tightened and $F_1$ increases, the second hoisting steel wire rope is relatively loosened and $F_2$ decreases, so as to make $F_1$ be equal to $F_2$ finally; and (2) let a tensile force on a third hoisting steel wire rope be $F_3$ and a tensile force on a fourth hoisting steel wire rope be $F_4$, where when $F_3=F_4$, a primary right drum is subject to balanced forces at two sides and does not rotate; when $F_3>F_4$, a force acting on a front side of the primary right drum is greater than that on its back side, and the primary right drum rotates counterclockwise, such that the third hoisting steel wire rope is relatively loosened and $F_3$ decreases, the fourth hoisting steel wire rope is relatively tightened and $F_4$ increases, so as to make $F_3$ be equal to $F_4$ finally; when $F_3<F_4$, a force acting on a front side of the primary right drum is less than that on its back side, and the primary right drum rotates clockwise, such that the third hoisting steel wire rope is relatively tightened and $F_3$ increases, the fourth hoisting steel wire rope is relatively loosened and $F_4$ decreases, so as to make $F_3$ be equal to $F_4$ finally; and (3) when $F_1+F_2=F_3+F_4$, a force acting on a front side of a secondary left drum and a force acting on a back side of a secondary right drum are balanced, and secondary revolving shafts fixedly connected to both the secondary left drum and the secondary right drum do not rotate; when $F_1+F_2>F_3+F_4$, the force acting on the front side of the secondary left drum is greater than the force acting on the back side of the secondary right drum, and the secondary revolving shafts fixedly connected to both the secondary left drum and the secondary right drum rotate counterclockwise, such that a steel wire rope on the front side of the secondary left drum is relatively loosened and the force thereon is reduced, a steel wire rope on the back side of the secondary right drum is relatively tightened and the force thereon is increased, so as to make $F_1+F_2=F_3+F_4$ finally; when $F_1+F_2<F_3+F_4$, the force acting on the front side of the secondary left drum is less than the force acting on the back side of the secondary right drum, and the secondary revolving shafts fixedly connected to both the secondary left drum and the secondary right drum rotate clockwise, such that a steel wire rope on the front side of the secondary left drum is relatively tightened and the force thereon is increased, a steel wire rope on the back side of the secondary right drum is relatively loosened and the force thereon is reduced, so as to make $F_1+F_2=F_3+F_4$ finally.

Beneficial effects: The present invention has the following advantages as compared with the prior art:

(1) The present invention can adjust tension of four steel wire ropes to equalize the tension, and can reach a long adjustment distance. Therefore, the present invention applies to tension adjustment for hoisting steel wire ropes of an ultra-deep vertical shaft, and meets requirement of tension adjustment in a hoisting process. Based on application of the present invention, a tension adjusting device using two steel wire ropes or any other even number of steel wire ropes can also be designed.

(2) In the present invention, a bearing pedestal and a pivot are connected, and a guide rail and a slider are connected, such that the device of the present invention has a simple structure; and is secure and reliable, conveniently mounted and adjusted, and easily detached.

(3) By use of a structure in which a steel wire rope is wound around a drum, tension of the hoisting steel wire rope is automatically adjusted by rotating the drum, thus effectively meeting the requirement of tension adjustment for the hoisting steel wire rope of the hoisting system, and providing a new solution to automatic tension adjustment for the hoisting steel wire rope.

Figure 1:
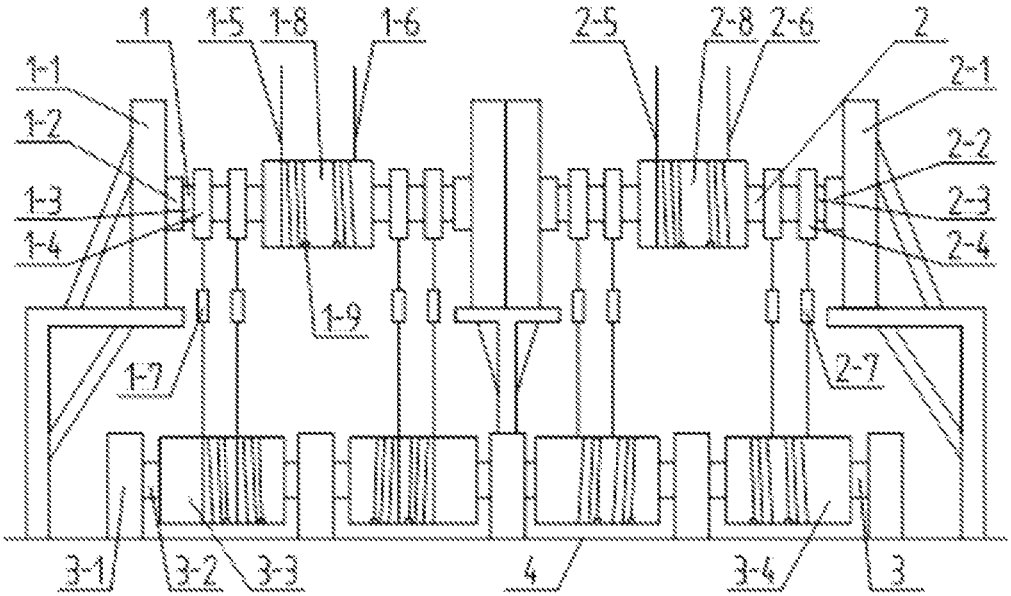
FIG. 1 is a front view of an overall structure of a tension adjusting device for a hoisting steel wire rope according to the present invention.

Meanings of reference numerals in the drawings are as follows: 1. Primary left steel wire rope tension adjusting device; 2. Primary right steel wire rope tension adjusting device; 3. Secondary steel wire rope tension adjusting device; 4. Hoisting container; 1-1. Primary left guide rail; 1-2. Primary left slider; 1-3. Primary left spindle; 1-4. Primary left connection block; 1-5. First hoisting steel wire rope; 1-6. Second hoisting steel wire rope; 1-7. Primary left steel wire rope connection device; 1-8. Primary left drum; 1-9. Rope head lock block; 2-1. Primary right guide rail; 2-2. Primary right slider; 2-3. Primary right spindle; 2-4. Primary right connection block; 2-5. Third hoisting steel wire rope; 2-6. Fourth hoisting steel wire rope; 2-7. Primary right steel wire rope connection device; 2-8. Primary right drum; 3-1. Fixed bearing pedestal; 3-2. Secondary revolving shaft; 3-3. Secondary left drum; and 3-4. Secondary right drum

DETAILED DESCRIPTION OF THE INVENTION

The present invention is further described below with reference to the accompanying drawings and embodiments.

A tension adjusting device for a hoisting steel wire rope of an ultra-deep vertical shaft provided by the present invention includes two stages of steel wire rope tension adjusting devices provided on a hoisting container. A primary steel wire rope tension adjusting device includes left and right steel wire rope tension adjusting devices that are symmetrically arranged, and the left and right steel wire rope tension adjusting devices each include guide rails, sliders, a spindle, connection blocks, and a primary drum. The guide rails, the sliders, and the connection blocks are successively symmetrically arranged on two sides of the spindle, the drum is provided on the middle portion of the spindle, two hoisting steel wire ropes are symmetrically wound around the drum, and rope head ends of the two hoisting steel wire ropes are fixed to the drum with rope head lock blocks. A secondary steel wire rope tension adjusting device is provided below the primary steel wire rope tension adjusting device, and includes a plurality of fixed bearing pedestals, revolving shafts, and secondary drums, where each revolving shaft is provided with one secondary drum, two ends of each revolving shaft are disposed inside the fixed bearing pedestals respectively, a steel wire rope is wound around each secondary drum, and two ends of the steel wire rope are respectively connected to the connection blocks of the primary steel wire rope tension adjusting device via steel wire rope connection devices.

Figure 2:
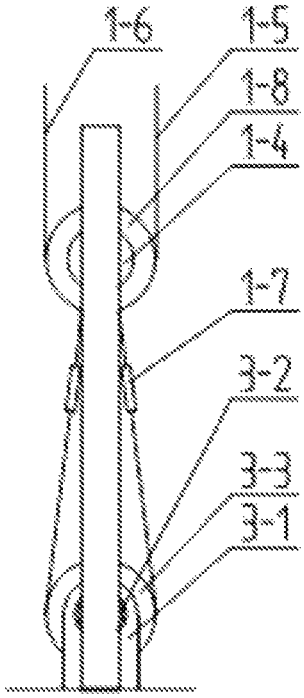
FIG. 2 is a side view of an overall structure of a tension adjusting device for a hoisting steel wire rope according to the present invention
Figure 3:
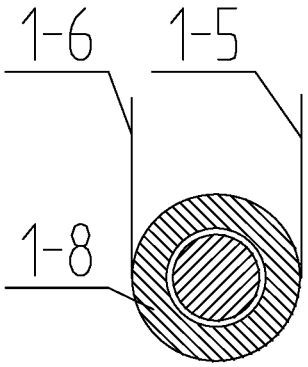
FIG. 3 is a cross-sectional view of a primary left drum of the present invention.
Figure 4:
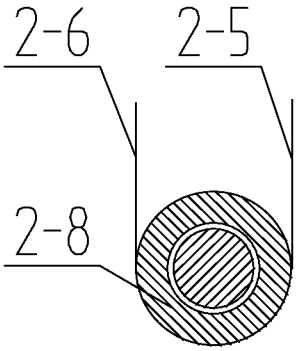
FIG. 4 is a cross-sectional view of a primary right drum of the present invention.
Figure 5:
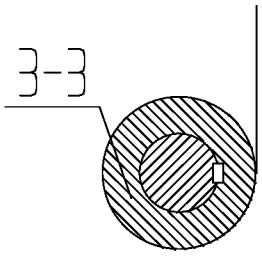
FIG. 5 is a cross-sectional view of a secondary left drum of the present invention.
Figure 6:
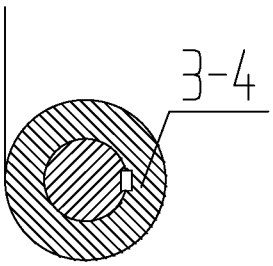
FIG. 6 is a cross-sectional view of a secondary right drum of the present invention.
Figure 7:
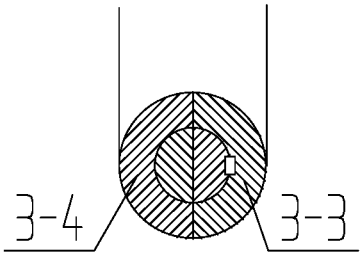
FIG. 7 is a stepped cross-sectional view of a secondary left drum and a secondary right drum of the present invention.

As shown in FIGS. 1 and 2, the left and right steel wire rope tension adjusting devices of the present invention specifically include a primary left steel wire rope tension adjusting device 1, a primary right steel wire rope tension adjusting device 2, and a secondary steel wire rope tension adjusting device 3. The primary left steel wire rope tension adjusting device 1 includes two primary left guide rails 1-1, two primary left sliders 1-2, a primary left spindle 1-3, one, two or three primary left connection blocks 1-4, a first hoisting steel wire rope 1-5 and a second hoisting steel wire rope 1-6, a primary left drum 1-8, rope head lock blocks 1-9, and one, two or three primary left steel wire rope connection devices 1-7. The primary right steel wire rope tension adjusting device 2 includes two primary right guide rails 2-1, two primary right sliders 2-2, a primary right spindle 2-3, one, two or three primary right connection blocks 2-4, a third hoisting steel wire rope 2-5 and a fourth hoisting steel wire rope 2-6, a primary right drum 2-8, and one, two or three primary right steel wire rope connection devices 2-7. The secondary steel wire rope tension adjusting device 3 includes five bearing pedestals 3-1, four secondary revolving shafts 3-2, two secondary left drums 3-3, and two secondary right drums 3-4.

The primary left guide rails 1-1 are rectangular guide rails, and fastened to the hoisting container 4. The primary left sliders 1-2 are square blocks, and fit snugly to inner walls of the primary left guide rails 1-1. Two ends of the primary left spindle 1-3 are fixedly connected to the two primary left sliders 1-2 respectively, and move up and down along the primary left guide rails 1-1 together. The primary left drum 1-8 is mounted on a middle portion of the primary left spindle 1-3 via a bearing, and is provided with spiral grooves for the steel wire ropes and lock blocks 1-9 for fastening rope heads of the first hoisting steel wire rope 1-5 and the second hoisting steel wire rope 1-6. The first hoisting steel wire rope 1-5 is wound around the primary left drum 1-8 by four or more turns and extends upwards from the front side of the primary left drum 1-8, and the second hoisting steel wire rope 1-6 is wound around the primary left drum 1-8 by four or more turns and extends upwards from the back side of the primary left drum 1-8. The primary left connection blocks 1-4 are fastened on two sides of the primary left drum 1-8. Each of the primary left steel wire rope connection devices 1-7 is connected upwards to one of the primary left connection blocks 1-4 via a steel wire rope, and a lower end thereof is fastened to a secondary left drum 3-3 by winding a steel wire rope from the front side of the drum.

The primary right guide rails 2-1 are rectangular guide rails, and fastened to the hoisting container 4. The primary right sliders 2-2 are square blocks, and fit snugly to inner walls of the primary right guide rails 2-1. Two ends of the primary right spindle 2-3 are fixedly connected to the two primary right sliders 2-2 respectively, and move up and down along the primary right guide rails 2-1 together. The primary right drum 2-8 is mounted on a middle portion of the primary right spindle 2-3 via a bearing, and is provided with spiral grooves for the steel wire ropes and lock blocks 1-9 for fastening rope heads of the third hoisting steel wire rope 2-5 and the fourth hoisting steel wire rope 2-6. The third hoisting steel wire rope 2-5 is wound around the primary right drum 2-8 by four or more turns and extends upwards from the front side of the primary right drum 2-8, and the fourth hoisting steel wire rope 2-6 is wound around the primary right drum 2-8 by four or more turns and extends upwards from the back side of the primary right drum 2-8. The primary right connection blocks 2-4 are fastened on two sides of the primary right drum 2-8. Each of the primary right steel wire rope connection devices 2-7 is connected upwards to one of the primary right connection blocks 2-4 via a steel wire rope, and a lower end thereof is fastened to a secondary right drum 3-4 by winding a steel wire rope from the back side of the drum by four or more turns.

The bearing pedestals are fastened to the hoisting container 4, and the secondary revolving shafts 3-2 are mounted on the multiple bearing pedestals 3-1. The secondary left drums 3-3 are mounted on the secondary revolving shafts 3-2 by means of a key connection and rotate in synchronization with the secondary revolving shafts 3-2, and the secondary left drums 3-3 are each provided with spiral grooves for the steel wire ropes and lock blocks 1-9 for fastening rope heads of the steel wire ropes. The secondary right drums 3-4 are mounted on the secondary revolving shafts 3-2 by means of a key connection and rotate in synchronization with the secondary revolving shafts 3-2, and the secondary right drums 3-4 are each provided with spiral grooves for the steel wire ropes and lock blocks 1-9 for fastening rope heads of the steel wire ropes. The secondary left drum 3-3 and the secondary right drum 3-4 are identical in diameter.

As shown in FIG. 3 to FIG. 7, the present invention further provides a tension adjusting method for a steel wire rope at a hoisting-container-end, which includes the following steps:

(1) Let a tensile force on a first hoisting steel wire rope 1-5 be $F_1$ and a tensile force on a second hoisting steel wire rope 1-6 be $F_2$. When $F_1=F_2$, a primary left drum 1-8 is subject to balanced forces at two sides and does not rotate. When $F_1>F_2$, a force acting on a front side of the primary left drum 1-8 is greater than that on its back side, and the primary left drum 1-8 rotates counterclockwise, such that the first hoisting steel wire rope 1-5 is relatively loosened and $F_1$ decreases, the second hoisting steel wire rope 1-6 is relatively tightened and $F_2$ increases, so as to make $F_1$ be equal to $F_2$ finally. When $F_1<F_2$, a force acting on a front side of the primary left drum 1-8 is less than that on its back side, and the primary left drum 1-8 rotates clockwise, such that the first hoisting steel wire rope 1-5 is relatively tightened and $F_1$ increases, the second hoisting steel wire rope 1-6 is relatively loosened and $F_2$ decreases, so as to make $F_1$ be equal to $F_2$ finally.

(2) Let a tensile force on a third hoisting steel wire rope 2-5 be $F_3$ and a tensile force on a fourth hoisting steel wire rope 2-6 be $F_4$. When $F_3=F_4$, a primary right drum 2-8 is subject to balanced forces at two sides and does not rotate. When $F_3>F_4$, a force acting on a front side of the primary right drum 2-8 is greater than that on its back side, and the primary right drum 2-8 rotates counterclockwise, such that the third hoisting steel wire rope 2-5 is relatively loosened and $F_3$ decreases, the fourth hoisting steel wire rope 2-6 is relatively tightened and $F_4$ increases, so as to make $F_3$ be equal to $F_4$ finally. When $F_3<F_4$, a force acting on a front side of the primary right drum 2-8 is less than that on its back side, and the primary right drum 2-8 rotates clockwise, such that the third hoisting steel wire rope 2-5 is relatively tightened and $F_3$ increases, the fourth hoisting steel wire rope 2-6 is relatively loosened and $F_4$ decreases, so as to make $F_3$ be equal to $F_4$ finally.

(3) When $F_1+F_2=F_3+F_4$, a force acting on a front side of a secondary left drum 3-3 and a force acting on a back side of a secondary right drum 3-4 are balanced, and secondary revolving shafts 3-2 fixedly connected to both the secondary left drum 3-3 and the secondary right drum 3-4 do not rotate. When $F_1+F_2>F_3+F_4$, the force acting on the front side of the secondary left drum 3-3 is greater than the force acting on the back side of the secondary right drum 3-4, and the secondary revolving shafts 3-2 fixedly connected to both the secondary left drum 3-3 and the secondary right drum 3-4 rotate counterclockwise, such that a steel wire rope on the front side of the secondary left drum is relatively loosened and the force thereon is reduced, a steel wire rope on the back side of the secondary right drum 3-4 is relatively tightened and the force thereon is increased, so as to make $F_1+F_2$ be equal to $F_3+F_4$ finally. When $F_1+F_2<F_3+F_4$, the force acting on the front side of the secondary left drum 3-3 is less than the force acting on the back side of the secondary right drum 3-4, and the secondary revolving shafts 3-2 fixedly connected to both the secondary left drum 3-3 and the secondary right drum 3-4 rotate clockwise, such that a steel wire rope on the front side of the secondary left drum is relatively tightened and the force thereon is increased, a steel wire rope on the back side of the secondary right drum 3-4 is relatively loosened and the force thereon is reduced, so as to make $F_1+F_2=F_3+F_4$ finally.

What is claimed is:

1. A device for adjusting tension of a steel wire rope of an ultra-deep vertical shaft at a hoisting-container-end, characterized in that, comprising two stages of steel wire rope tension adjusting devices provided on a hoisting container (4), wherein a primary steel wire rope tension adjusting device comprises left and right steel wire rope tension adjusting devices that are symmetrically arranged, and the left and right steel wire rope tension adjusting devices each comprise guide rails, sliders, a spindle, connection blocks, and a drum; the guide rails, the sliders, and the connection blocks are successively symmetrically arranged on two sides of the spindle, the drum is provided on the middle portion of the spindle, two hoisting steel wire ropes are symmetrically wound around the drum, and rope head ends of the two hoisting steel wire ropes are fixed to the drum with rope head lock blocks; and a secondary steel wire rope tension adjusting device (3) is provided below the primary steel wire rope tension adjusting device, and comprises a plurality of fixed bearing pedestals, revolving shafts, and drums, wherein each revolving shaft is provided with one drum, two ends of each revolving shaft are disposed inside the fixed bearing pedestals respectively, steel wire ropes are wound around each drum, and ends of the steel wire ropes are respectively connected to the connection blocks of the primary steel wire rope tension adjusting device via steel wire rope connection devices.

2. The device for adjusting tension of a steel wire rope of an ultra-deep vertical shaft at a hoisting-container-end according to claim 1, characterized in that, the left and right steel wire rope tension adjusting devices specifically comprise a primary left steel wire rope tension adjusting device (1) and a primary right steel wire rope tension adjusting device (2); the primary left steel wire rope tension adjusting device (1) comprises two primary left guide rails (1-1), two primary left sliders (1-2), a primary left spindle (1-3), primary left connection blocks (1-4), a first hoisting steel wire rope (1-5) and a second hoisting steel wire rope (1-6), a primary left drum (1-8), rope head lock blocks (1-9), and primary left steel wire rope connection devices (1-7); the primary left guide rails (1-1) are fastened to the hoisting container (4), and the primary left sliders (1-2) fit snugly to inner walls of the primary left guide rails (1-1); two ends of the primary left spindle (1-3) are fixedly connected to the primary left sliders (1-2) respectively, and move up and down along the primary left guide rails (1-1) together; the primary left drum (1-8) is mounted on a middle portion of the primary left spindle (1-3) via a bearing, and is provided with spiral grooves for the steel wire ropes and lock blocks (1-9) for fastening rope heads of the first hoisting steel wire rope (1-5) and the second hoisting steel wire rope (1-6); the first hoisting steel wire rope (1-5) is wound around the primary left drum (1-8) and extends upwards from a front side of the primary left drum (1-8), and the second hoisting steel wire rope (1-6) is wound around the primary left drum (1-8) and extends upwards from a back side of the primary left drum (1-8); the primary left connection blocks (1-4) are fastened on two sides of the primary left drum (1-8); and each of the primary left steel wire rope connection devices (1-7) is connected upwards to one of the primary left connection blocks (1-4) via a steel wire rope, and connected downwards to a steel wire rope which is wound around a secondary left drum (3-3) from a front side of the secondary left drum; and the primary right steel wire rope tension adjusting device (2) comprises two primary right guide rails (2-1), two primary right sliders (2-2), a primary right spindle (2-3), primary right connection blocks (2-4), a third hoisting steel wire rope (2-5) and a fourth hoisting steel wire rope (2-6), a primary right drum (2-8), and primary right steel wire rope connection devices (2-7); the primary right guide rails (2-1) are fastened to the hoisting container (4), and the primary right sliders (2-2) fit snugly to inner walls of the primary right guide rails (2-1); two ends of the primary right spindle (2-3) are fixedly connected to the two primary right sliders (2-2) respectively, and move up and down along the primary right guide rails (2-1) together; the primary right drum (2-8) is mounted on a middle portion of the primary right spindle (2-3) via a bearing, and is provided with spiral grooves for the steel wire ropes and lock blocks (1-9) for fastening rope heads of the third hoisting steel wire rope (2-5) and the fourth hoisting steel wire rope (2-6); the third hoisting steel wire rope (2-5) is wound around the primary right drum (2-8) by four or more turns and extends upwards from a front side of the primary right drum (2-8), and the fourth hoisting steel wire rope (2-6) is wound around the primary right drum (2-8) by four or more turns and extends upwards from a back side of the primary right drum (2-8); the primary right connection blocks (2-4) are fastened on two sides of the primary right drum (2-8); and each of the primary right steel wire rope connection devices (2-7) is connected upwards to one of the primary right connection blocks (2-4) via a steel wire rope, and connected downwards to a steel wire rope which is wound around a secondary right drum (3-4) from a back side of the secondary right drum.

3. The device for adjusting tension of a steel wire rope of an ultra-deep vertical shaft at a hoisting-container-end according to claim 2, characterized in that, one, two or three said primary left connection blocks (1-4) are provided, and each primary left connection block (1-4) is provided with one primary left steel wire rope connection device (1-7); and one, two or three said primary right connection blocks (2-4) are provided, and each primary right connection block (2-4) is provided with one primary right steel wire rope connection device (2-7).

4. The device for adjusting tension of a steel wire rope of an ultra-deep vertical shaft at a hoisting-container-end according to claim 2, characterized in that, the primary left guide rails (1-1) and the primary right guide rails (2-1) are all rectangular guide rails, and the primary left sliders (1-2) and the primary right sliders (2-2) are all square blocks.

5. The device for adjusting tension of a steel wire rope of an ultra-deep vertical shaft at a hoisting-container-end according to claim 2, characterized in that, the first hoisting steel wire rope (1-5) and the second hoisting steel wire rope (1-6) are wound around the primary left drum (1-8) by at least four turns, and the third hoisting steel wire rope (2-5) and the fourth hoisting steel wire rope (2-6) are wound around the primary right drum (2-8) by at least four turns.

6. A method for adjusting tension of a steel wire rope of an ultra-deep vertical shaft at a hoisting-container-end using the device according to claim 2, characterized in that, comprising the following steps:

(1) let a tensile force on a first hoisting steel wire rope (1-5) be $F_1$ and a tensile force on a second hoisting steel wire rope (1-6) be $F_2$, wherein when $F_1=F_2$, a primary left drum (1-8) is subject to balanced forces at two sides and does not rotate; when $F_1>F_2$, a force acting on a front side of the primary left drum (1-8) is greater than that on a back side of the primary left drum (1-8), and the primary left drum (1-8) rotates counterclockwise, such that the first hoisting steel wire rope (1-5) is relatively loosened and $F_1$ decreases, the second hoisting steel wire rope (1-6) is relatively tightened and $F_2$ increases, so as to make $F_1$ be equal to $F_2$ finally; when $F_1<F_2$, a force acting on the front side of the primary left drum (1-8) is less than that on the back side of the primary left drum (1-8), and the primary left drum (1-8) rotates clockwise, such that the first hoisting steel wire rope (1-5) is relatively tightened and $F_1$ increases, the second hoisting steel wire rope (1-6) is relatively loosened and $F_2$ decreases, so as to make $F_1$ be equal to $F_2$ finally; and (2) let a tensile force on a third hoisting steel wire rope (2-5) be $F_3$ and a tensile force on a fourth hoisting steel wire rope (2-6) be $F_2$, wherein when $F_1=F_2$, a primary right drum (2-8) is subject to balanced forces at two sides and does not rotate; when $F_3>F_4$, a force acting on a front side of the primary right drum (2-8) is greater than that on a back side of the primary right drum (2-8), and the primary right drum (2-8) rotates counterclockwise, such that the third hoisting steel wire rope (2-5) is relatively loosened and $F_3$ decreases, the fourth hoisting steel wire rope (2-6) is relatively tightened and $F_4$ increases, so as to make $F_3$ be equal to $F_4$ finally; when $F_3<F_4$, a force acting on the front side of the primary right drum (2-8) is less than that on the back side of the primary right drum (2-8), and the primary right drum (2-8) rotates clockwise, such that the third hoisting steel wire rope (2-5) is relatively tightened and $F_3$ increases, the fourth hoisting steel wire rope (2-6) is relatively loosened and $F_4$ decreases, so as to make $F_3$ be equal to $F_4$ finally; and (3) when $F_1+F_2=F_3+F_4$, a force acting on a front side of a secondary left drum (3-3) and a force acting on a back side of a secondary right drum (3-4) are balanced, and secondary revolving shafts (3-2) fixedly connected to both the secondary left drum (3-3) and the secondary right drum (3-4) do not rotate; when $F_1+F_2>F_3+F_4$, the force acting on the front side of the secondary left drum (3-3) is greater than the force acting on the back side of the secondary right drum (3-4), and the secondary revolving shafts (3-2) fixedly connected to both the secondary left drum (3-3) and the secondary right drum (3-4) rotate counterclockwise, such that a steel wire rope on the front side of the secondary left drum is relatively loosened and the force thereon is reduced, a steel wire rope on the back side of the secondary right drum (3-4) is relatively tightened and the force thereon is increased, so as to make $F_1+F_2=F_3+F_4$ finally; when $F_1+F_2<F_3+F_4$, the force acting on the front side of the secondary left drum (3-3) is less than the force acting on the back side of the secondary right drum (3-4), and the secondary revolving shafts (3-2) fixedly connected to both the secondary left drum (3-3) and the secondary right drum (3-4) rotate clockwise, such that the steel wire rope on the front side of the secondary left drum is relatively tightened and the force thereon is increased, the steel wire rope on the back side of the secondary right drum (3-4) is relatively loosened and the force thereon is reduced, so as to make $F_1+F_2=F_3+F_4$ finally.

7. The device for adjusting tension of a steel wire rope of an ultra-deep vertical shaft at a hoisting-container-end according to claim 1, characterized in that, one, two or three said primary left connection blocks (1-4) are provided, and each primary left connection block (1-4) is provided with one primary left steel wire rope connection device (1-7); and one, two or three said primary right connection blocks (2-4) are provided, and each primary right connection block (2-4) is provided with one primary right steel wire rope connection device (2-7).

8. The device for adjusting tension of a steel wire rope of an ultra-deep vertical shaft at a hoisting-container-end according to claim 1, characterized in that, the primary left guide rails (1-1) and the primary right guide rails (2-1) are all rectangular guide rails, and the primary left sliders (1-2) and the primary right sliders (2-2) are all square blocks.

9. The device for adjusting tension of a steel wire rope of an ultra-deep vertical shaft at a hoisting-container-end according to claim 1, characterized in that, the first hoisting steel wire rope (1-5) and the second hoisting steel wire rope (1-6) are wound around the primary left drum (1-8) by at least four turns, and the third hoisting steel wire rope (2-5) and the fourth hoisting steel wire rope (2-6) are wound around the primary right drum (2-8) by at least four turns.

10. The device for adjusting tension of a steel wire rope of an ultra-deep vertical shaft at a hoisting-container-end according to claim 1, characterized in that, the plurality of fixed bearing pedestals, revolving shafts, and drums comprising the secondary steel wire rope tension adjusting device are specifically five bearing pedestals (3-1), four secondary revolving shafts (3-2), two secondary left drums (3-3), and two secondary right drums (3-4); the bearing pedestals (3-1) are fastened to the hoisting container (4), and the secondary revolving shafts (3-2) are mounted on the five bearing pedestals (3-1); the secondary left drums (3-3) are mounted respectively on the secondary revolving shafts (3-2) by means of a key connection and rotate in synchronization with the secondary revolving shafts (3-2), and the secondary left drums (3-3) are each provided with spiral grooves for the steel wire ropes and lock blocks (1-9) for fastening rope heads of the steel wire ropes; the secondary right drums (3-4) are mounted on the secondary revolving shafts (3-2) by means of a key connection and rotate in synchronization with the secondary revolving shafts (3-2), and the secondary right drums (3-4) are each provided with spiral grooves for the steel wire ropes and lock blocks (1-9) for fastening rope heads of the steel wire ropes; and the secondary left drums (3-3) and the secondary right drums (3-4) are identical in diameter.

11. A method for adjusting tension of a steel wire rope of an ultra-deep vertical shaft at a hoisting-container-end using the device according to claim 10, characterized in that, comprising the following steps:

(1) let a tensile force on a first hoisting steel wire rope (1-5) be $F_1$ and a tensile force on a second hoisting steel wire rope (1-6) be $F_2$, wherein when $F_1=F_2$, a primary left drum (1-8) is subject to balanced forces at two sides and does not rotate; when $F_1>F_2$, a force acting on a front side of the primary left drum (1-8) is greater than that on a back side of the primary left drum (1-8), and the primary left drum (1-8) rotates counterclockwise, such that the first hoisting steel wire rope (1-5) is relatively loosened and $F_1$ decreases, the second hoisting steel wire rope (1-6) is relatively tightened and $F_2$ increases, so as to make $F_1$ be equal to $F_2$ finally; when $F_1<F_2$, a force acting on the front side of the primary left drum (1-8) is less than that on the back side of the primary left drum (1-8), and the primary left drum (1-8) rotates clockwise, such that the first hoisting steel wire rope (1-5) is relatively tightened and $F_1$ increases, the second hoisting steel wire rope (1-6) is relatively loosened and $F_2$ decreases, so as to make $F_1$ be equal to $F_2$ finally; and (2) let a tensile force on a third hoisting steel wire rope (2-5) be $F_3$ and a tensile force on a fourth hoisting steel wire rope (2-6) be $F_2$, wherein when $F_1=F_2$, a primary right drum (2-8) is subject to balanced forces at two sides and does not rotate; when $F_3>F_4$, a force acting on a front side of the primary right drum (2-8) is greater than that on a back side of the primary right drum (2-8), and the primary right drum (2-8) rotates counterclockwise, such that the third hoisting steel wire rope (2-5) is relatively loosened and $F_3$ decreases, the fourth hoisting steel wire rope (2-6) is relatively tightened and $F_4$ increases, so as to make $F_3$ be equal to $F_4$ finally; when $F_3<F_4$, a force acting on the front side of the primary right drum (2-8) is less than that on the back side of the primary right drum (2-8), and the primary right drum (2-8) rotates clockwise, such that the third hoisting steel wire rope (2-5) is relatively tightened and $F_3$ increases, the fourth hoisting steel wire rope (2-6) is relatively loosened and $F_4$ decreases, so as to make $F_3$ be equal to $F_4$ finally; and (3) when $F_1+F_2=F_3+F_4$, a force acting on a front side of a secondary left drum (3-3) and a force acting on a back side of a secondary right drum (3-4) are balanced, and secondary revolving shafts (3-2) fixedly connected to both the secondary left drum (3-3) and the secondary right drum (3-4) do not rotate; when $F_1+F_2>F_3+F_4$, the force acting on the front side of the secondary left drum (3-3) is greater than the force acting on the back side of the secondary right drum (3-4), and the secondary revolving shafts (3-2) fixedly connected to both the secondary left drum (3-3) and the secondary right drum (3-4) rotate counterclockwise, such that a steel wire rope on the front side of the secondary left drum is relatively loosened and the force thereon is reduced, a steel wire rope on the back side of the secondary right drum (3-4) is relatively tightened and the force thereon is increased, so as to make $F_1+F_2=F_3+F_4$ finally; when $F_1+F_2<F_3+F_4$, the force acting on the front side of the secondary left drum (3-3) is less than the force acting on the back side of the secondary right drum (3-4), and the secondary revolving shafts (3-2) fixedly connected to both the secondary left drum (3-3) and the secondary right drum (3-4) rotate clockwise, such that the steel wire rope on the front side of the secondary left drum is relatively tightened and the force thereon is increased, the steel wire rope on the back side of the secondary right drum (3-4) is relatively loosened and the force thereon is reduced, so as to make $F_1+F_2=F_3+F_4$ finally.

12. A method for adjusting tension of a steel wire rope of an ultra-deep vertical shaft at a hoisting-container-end using the device according to claim 1, characterized in that, comprising the following steps:

(1) let a tensile force on a first hoisting steel wire rope (1-5) be $F_1$ and a tensile force on a second hoisting steel wire rope (1-6) be $F_2$, wherein when $F_1=F_2$, a primary left drum (1-8) is subject to balanced forces at two sides and does not rotate; when $F_1>F_2$, a force acting on a front side of the primary left drum (1-8) is greater than that on a back side of the primary left drum (1-8), and the primary left drum (1-8) rotates counterclockwise, such that the first hoisting steel wire rope (1-5) is relatively loosened and $F_1$ decreases, the second hoisting steel wire rope (1-6) is relatively tightened and $F_2$ increases, so as to make $F_1$ be equal to $F_2$ finally; when $F_1<F_2$, a force acting on the front side of the primary left drum (1-8) is less than that on the back side of the primary left drum (1-8), and the primary left drum (1-8) rotates clockwise, such that the first hoisting steel wire rope (1-5) is relatively tightened and $F_1$ increases, the second hoisting steel wire rope (1-6) is relatively loosened and $F_2$ decreases, so as to make $F_1$ be equal to $F_2$ finally; and (2) let a tensile force on a third hoisting steel wire rope (2-5) be $F_3$ and a tensile force on a fourth hoisting steel wire rope (2-6) be $F_2$, wherein when $F_1=F_2$, a primary right drum (2-8) is subject to balanced forces at two sides and does not rotate; when $F_3>F_4$, a force acting on a front side of the primary right drum (2-8) is greater than that on a back side of the primary right drum (2-8), and the primary right drum (2-8) rotates counterclockwise, such that the third hoisting steel wire rope (2-5) is relatively loosened and $F_3$ decreases, the fourth hoisting steel wire rope (2-6) is relatively tightened and $F_4$ increases, so as to make $F_3$ be equal to $F_4$ finally; when $F_3<F_4$, a force acting on the front side of the primary right drum (2-8) is less than that on the back side of the primary right drum (2-8), and the primary right drum (2-8) rotates clockwise, such that the third hoisting steel wire rope (2-5) is relatively tightened and $F_3$ increases, the fourth hoisting steel wire rope (2-6) is relatively loosened and $F_4$ decreases, so as to make $F_3$ be equal to $F_4$ finally; and (3) when $F_1+F_2=F_3+F_4$, a force acting on a front side of a secondary left drum (3-3) and a force acting on a back side of a secondary right drum (3-4) are balanced, and secondary revolving shafts (3-2) fixedly connected to both the secondary left drum (3-3) and the secondary right drum (3-4) do not rotate; when $F_1+F_2>F_3+F_4$, the force acting on the front side of the secondary left drum (3-3) is greater than the force acting on the back side of the secondary right drum (3-4), and the secondary revolving shafts (3-2) fixedly connected to both the secondary left drum (3-3) and the secondary right drum (3-4) rotate counterclockwise, such that a steel wire rope on the front side of the secondary left drum is relatively loosened and the force thereon is reduced, a steel wire rope on the back side of the secondary right drum (3-4) is relatively tightened and the force thereon is increased, so as to make $F_1+F_2=F_3+F_4$ finally; when $F_1+F_2<F_3+F_4$, the force acting on the front side of the secondary left drum (3-3) is less than the force acting on the back side of the secondary right drum (3-4), and the secondary revolving shafts (3-2) fixedly connected to both the secondary left drum (3-3) and the secondary right drum (3-4) rotate clockwise, such that the steel wire rope on the front side of the secondary left drum is relatively tightened and the force thereon is increased, the steel wire rope on the back side of the secondary right drum (3-4) is relatively loosened and the force thereon is reduced, so as to make $F_1+F_2=F_3+F_4$ finally.

* * * * *